United States Patent [19]

Grehl

[11] Patent Number: 4,505,183

[45] Date of Patent: Mar. 19, 1985

[54] GAS ACTUATED OPERATING MECHANISM FOR AUTOLOADING FIREARM

[75] Inventor: William H. Grehl, Wallingford, Conn.

[73] Assignee: O. F. Mossberg & Sons, Inc., North Haven, Conn.

[21] Appl. No.: 446,396

[22] Filed: Dec. 2, 1982

[51] Int. Cl.[3] ..... F41D 5/04

[52] U.S. Cl. ..... 89/191.01

[58] Field of Search ..... 89/191, 191 A, 42 R, 89/179, 193; 42/1 W

[56] References Cited

U.S. PATENT DOCUMENTS

| | | | |
|---|---|---|---|
| 2,909,101 | 10/1959 | Hillberg | 89/191 |
| 3,105,411 | 10/1963 | Browning | 89/177 |
| 3,115,063 | 12/1963 | Browning | 89/177 |
| 3,200,710 | 8/1965 | Kelly et al. | 89/191 A |
| 3,443,477 | 5/1969 | Kaempf | 89/191 A |
| 3,580,132 | 5/1971 | Vartanian | 89/130 |
| 3,601,002 | 8/1971 | Janson | 89/191 A |
| 3,848,511 | 11/1974 | Zanari | 89/191 A |

FOREIGN PATENT DOCUMENTS

| | | | |
|---|---|---|---|
| 524641 | 8/1940 | United Kingdom | 89/191 |

*Primary Examiner*—Richard E. Schafer
*Assistant Examiner*—David K. Cornwell
*Attorney, Agent, or Firm*—McCormick, Paulding & Huber

[57] ABSTRACT

A semiautomatic shotgun having a gas operating mechanism for unlocking a bolt and moving it from battery position. The operating mechanism includes an action bar and an inertia weight assembly which comprises a plurality of inertia elements. The inertia elements, the action bar and the bolt are arranged for movement relative to each other and impact at different times during the operating cycle. A return spring cooperates with the inertia weight assembly to maintain the various parts of the mechanism in fixed position relative to each other when the bolt is locked in battery.

18 Claims, 7 Drawing Figures

32
34
54
62
6
5
7
56
44
36
38

58
66
46
60
47

50
49
52
48
70

63
64

GAS ACTUATED OPERATING MECHANISM FOR AUTOLOADING FIREARM

BACKGROUND OF THE INVENTION

This invention relates in general to gas operated firearms and deals more particularly with an improved gas actuated operating mechanism for a semiautomatic firearm. The operating mechanism of the present invention is particularly adapted for use in an autoloaded shotgun of the type wherein gases of explosion, developed on discharge of the firearm, are bled from the gun bore to a gas cylinder to react upon a piston which exerts impelling force upon an inertia weight comprising part of the mechanism. The inertia weight, connected to a bolt assembly through an action bar, provides initial impetus to unlock the bolt and urge it from its battery position toward a retired position, whereupon the spent shell is extracted and ejected, the trigger mechanism is cocked, and a spring for returning the bolt assembly to battery is compressed. Shotguns having gas actuated operating mechanisms of the aforedescribed general type are illustrated and described in U.S. Pat. No. 2,909,101 to Hillberg, assigned to High Standard Manufacturing Corporation, et al; U.S. Pat. No. 3,200,710 to Kelly et al, assigned to Remington Arms Company, Inc.; and U.S. Pat. No. 3,580,132 to Vartanian, assigned to Olin Mathieson Chemical Corporation.

In a firearm of the aforedescribed general type, such as the one shown in the aforementioned patent to Hillberg, for example, wherein the bolt assembly and the various parts of the operating mechanism for moving it are secured in fixed relation to each other and move as a unit, all of the parts which comprise the unit impact simultaneously. This impact must be absorbed by the receiver. In addition to adding substantially to recoil, the various parts of the mechanism are subjected to substantial stress, requiring that the parts be heavier in section and of higher material strength than might otherwise be required, all of which adds substantially to the weight of the gun.

This problem has been overcome, to some degree, by providing for travel allowance between the various parts of the mechanism, taught by Vartanian. Firearms have heretofore been provided wherein such travel allowances enable the bolt assembly, the action bar, and the inertia weight to impact separately and at different times during an operating cycle whereby the total impact of the mechanism is divided and occurs in stages as three separate and distinct impacts.

In mechanisms of the aforedescribed general type the action bar often serves to block a bolt locking member in locking position when the bolt assembly is in battery. In such a mechanism, it is generally desirable that the action bar be positively retained in fixed position relative to the bolt assembly, or more specifically the bolt locking element associated therewith, whereby to assure positive retention of the locking element in locked position when the bolt assembly is in battery. However, the aforediscussed requirement for travel allowance between various parts of the mechanism has made it difficult to produce a satisfactory system which fully meets this objective.

In the aforementioned patent to Vartanian, for example, an auxiliary spring is provided which acts between an action bar and an inertia weight to maintain the latter elements in abutting contact when the bolt assembly is in battery position. While such an arrangement may be useful to eliminate free play or looseness between parts of a system, is not particularly satisfactory for maintaining an action bar in blocking position relative to a bolt locking element, because it lacks the requisite fail-safe feature essential to such a mechanism. Should the auxiliary spring be broken or damaged, the action bar could move from its blocking position relative to the bolt locking element, while the gun remains otherwise operative.

Accordingly, it is the general aim of the present invention to provide an improved gas actuated bolt operating mechanism of the aforedescribed general type which provides for further division of impact load, while assuring positive bolt lock-up in battery position.

SUMMARY OF THE INVENTION

In accordance with the present invention an improved autoloading firearm is provided which has a receiver, a barrel secured to the receiver and having a bore, a breech bolt assembly supported within the receiver for movement between battery and retired positions, and gas actuated operating means for moving the bolt from its battery position toward a retired position. The operating means includes inertia weight means, means connecting the inertia weight means to the bolt assembly, and means for moving the inertia weight means in response to force exerted by expanding gases of explosion produced when the firearm is discharged. In accordance with the invention the firearm includes an improved inertia weight assembly which cooperates with the connecting means to releasably retain the connecting means in fixed position relative to the bolt assembly when the latter assembly is in battery position and which is movable relative to the connecting means during movement of the breech bolt assembly from its battery position. The inertia means comprises an inertia assembly and includes a plurality of individual inertia elements which travel substantially independently of each other and at different rates to impact at different times during the operating cycle.

DETAILED DESCRIPTION OF PREFERRED EMBODIMENT

Figure 1:
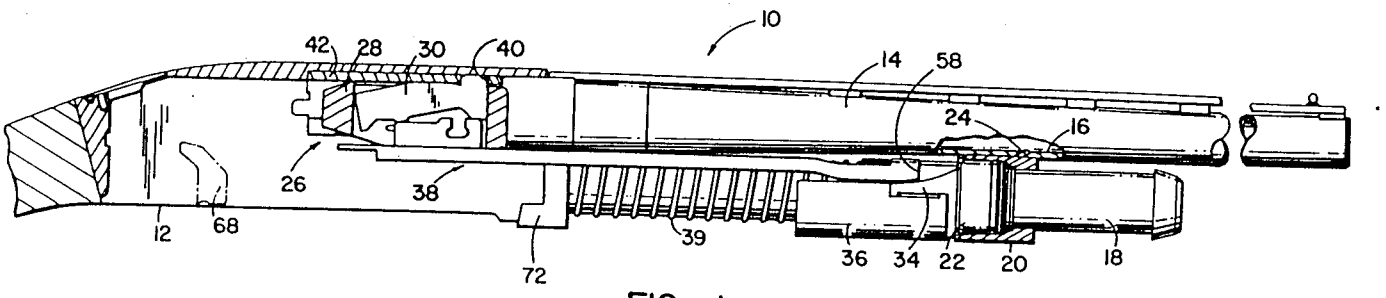
FIG. 1 is a somewhat diagramatic fragmentary sectional side elevational view of a shotgun embodying the invention and shown in battery.

Turning now to the drawings, the invention is illustrated with reference to an autoloaded shotgun indicated generally by the reference numeral 10. Various parts of the gun 10, not essential to an understanding of the invention, and which are or may be of conventional type, such as the hammer, trigger, extractor, ejector and elevator mechanisms have been omitted from the drawings, for purposes of clarity. The illustrated shotgun 10 generally comprises a receiver 12 and a barrel 14 which projects from the receiver and defines a bore 16. Secured to the receiver 12 below and coextensive with the barrel 14 is a magazine tube 18, the rear end of which is in open communication with the receiver 12. The magazine tube contains a magazine spring (not shown), for urging successive shells from the tube to a loading position within the receiver, and is closed at its forward end by a conventional releasably secured magazine cap.

A gas cylinder 20 depends from the barrel forward of the receiver 12 and coaxially surrounds an associated portion of the magazine tube 18. The cylinder 20 cooperates with the magazine tube 18 to define an annular gas chamber 22 therebetween, as shown in FIG. 1. Communication between the gas chamber 22 and the bore 16 is provided by a gas port 24 defined by the barrel 14 and the gas cylinder 20. The gas port allows gases of explosion to enter the gas chamber 22 from the bore when the gun is discharged, as will be hereinafter more fully discussed.

Figure 2:
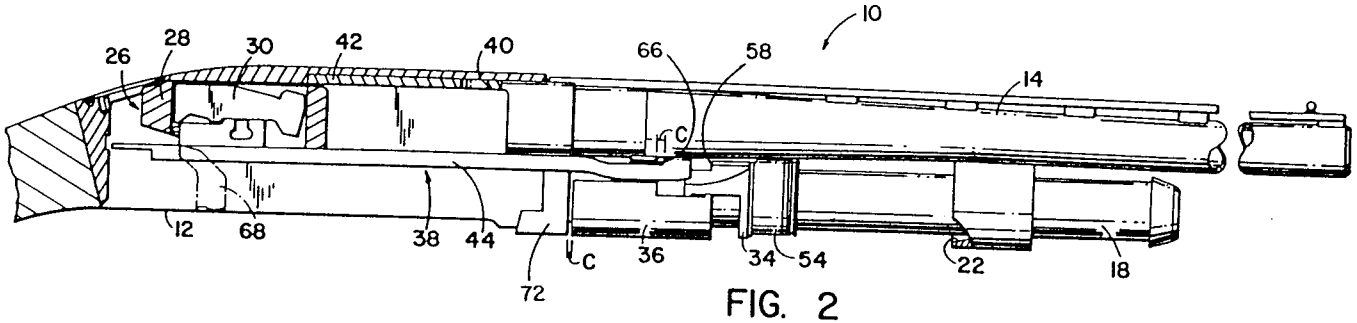
FIG. 2 is similar to FIG. 1 but shows the gun after firing, the breech bolt being in a retired position.

A breech bolt assembly, indicated generally by the numeral 26, and which includes a bolt 28 and a bolt locking element 30, is slidably supported in the receiver for reciprocation between battery and retired positions. In FIG. 1 the bolt assembly is shown locked in battery position, whereas in FIG. 2 it appears in a retired position.

In accordance with the invention, the gun 10 further includes a gas actuated operating mechanism which comprises a generally annular inertia weight assembly, designated generally by the numeral 32, which includes a front part or element 34 and a rear part or element 36 connected to the front part by a connection, which permits limited movement of the parts relative to each other but prevents separation of the parts. An action bar assembly, indicated generally at 38, engaged at its forward end by the inertia weight assembly 32, extends rearwardly in generally parallel alignment with the gun barrel 14. The rear end of the action bar is connected in a convention manner to the bolt 28. A return spring 39 coaxially surrounds the magazine tube 18 and acts between the inertia weight assembly 32 and the receiver 12 to normally bias the inertia weight assembly, the action bar 38 and the bolt assembly in the direction of the gas cylinder 20. When the breech bolt is in battery position a rear portion of the action bar is disposed in blocking relation to the bolt locking element 30 and positively retains the locking element in locked position in a locking recess 40 within the receiver and defined by a rearward extension of the barrel indicated at 42.

The operating mechanism is driven by a piston which may comprise a separate element supported for limited movement within the gas cylinder for exerting thrust upon the inertia weight assembly 32 in response to the reactive force of the expanding gases of explosion acting upon the piston, but preferably and as shown, the piston comprises a part of the inertia weight assembly and more specifically an integral part of the front inertia element 34, as hereinafter further described.

The moving parts of the mechanism which includes the bolt assembly 26, the action bar 38, and the front and rear inertia elements 34, and 36 have different weights and are arranged for limited movement relative to each other so that each of the elements which comprise the system may travel independently of the other elements and at its own rate. Thus, for example, in a typical system the front inertia element may weigh approximately $3\frac{1}{2}$ ounces ($99_g$), the rear inertia element 5 ounces ($142_g$), the action bar $4\frac{1}{2}$ ounces ($128_g$), and the bolt assembly $6\frac{1}{2}$ ounces ($184_g$).

Considering now the structure of the gun 10 in somewhat further detail, the action bar 38 comprises a pair of elongated parallel side members 44, 44 joined at the forward end by a transversely extending connecting portion 46. A pair of opposing inwardly extending ribs 47, 47 are formed on downwardly offset forward end portions of the side members 44, 44 immediately to the rear of the connecting portion 46. The rear ends of the side members 44, 44 are connected by a platform 49 which extends therebetween and includes a rearwardly extending tailpiece 48. A conventional cam element 50 mounted on the platform 49 and disposed within a recess in the bolt has a spring projected buffer 52 and operates the bolt locking element 30, in a manner well known in the art. An upwardly opening notch in the cam element receives and releasably retains a cocking lever (not shown) which extends through slots in associated walls of the bolt and the receiver.

The front inertia element 34 has an integral annular piston 54 at its forward end. The bore diameter of the piston is substantially equal to the outside diameter of the magazine tube 18 on which element 34 is received. A pair of piston rings are disposed within annular grooves formed in the piston. The rear portion of the element 34 is generally semi-cylindrical and has a pair of downwardly projecting lugs 56, 56 at its rear end. A relieved portion of the front inertia element 34 defines a rearwardly facing abutment surface 58 for engaging the forward end of the action bar connecting portion 46.

The rear inertia element 36 is generally particylindrical, but includes a generally circular central portion 60, which encircles the magazine tube to retain the inertia element in assembly with the tube for sliding movement therealong. The front portion of the rear inertia element 36 is generally semi-cylindrical and complements the rear portion of the front inertia element 34. A pair of generally diametrically opposed lugs 62, 62 project upwardly at the front of the element. The lugs 62, 62 cooperate with the lugs 56, 56 on the front inertia element to prevent the two elements from separating, which could result in angular misalignment during operation.

The rear portion of the rear inertia element is particylindrical and has an inside diameter slightly larger than the outside diameter of the return spring 39. A rearwardly facing annular shoulder 63 on the central portion 60 provides a seating surface for the return spring. Notches 64, 64 in opposite sides of the central portion 60 receive the ribs 47, 47 to assure smooth sliding travel of the action bar 38 relative to the rear inertia element 36. The central portion also defines a forwardly facing abutment surface 66 for engaging the rear surface of the connecting portion 46.

Figures 3, 4, 5, 6, 7:
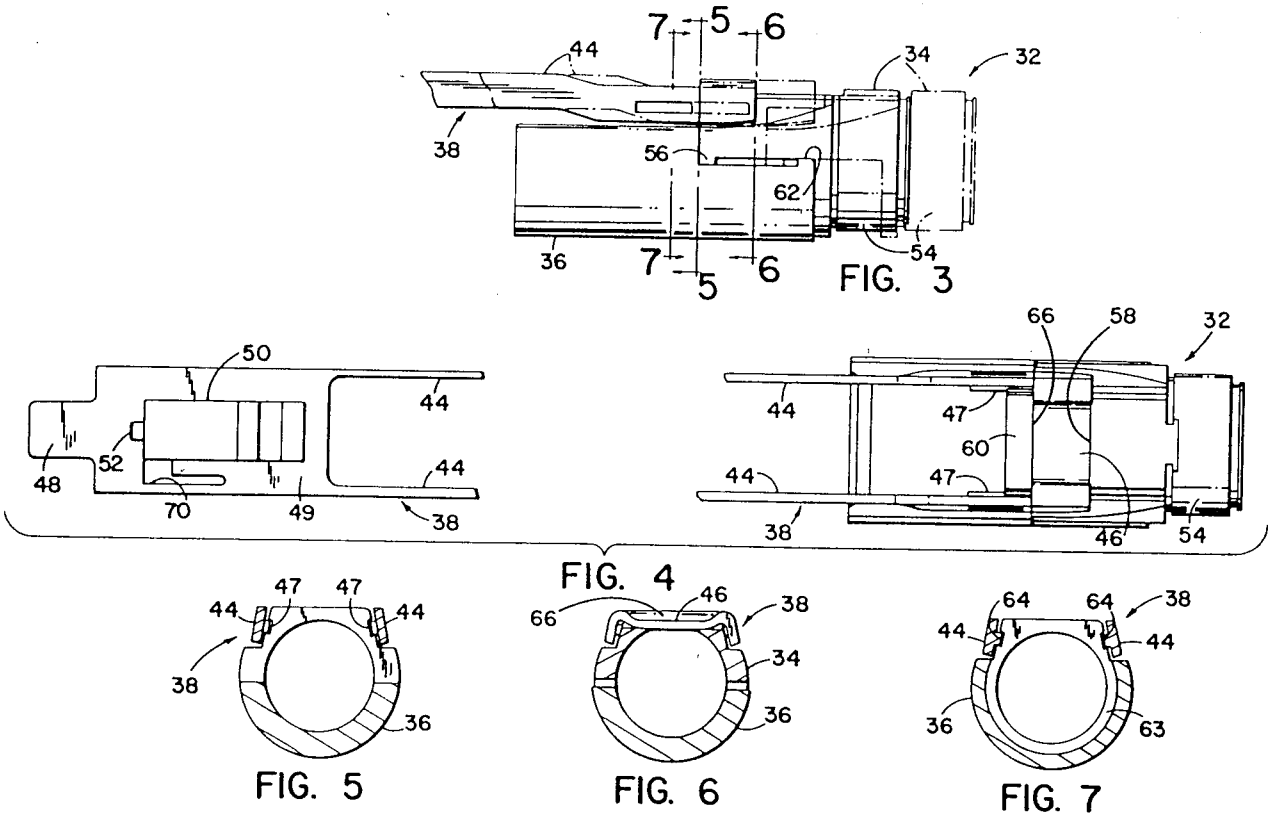
FIG. 3 is a somewhat enlarged fragmentary side elevational view of the inertia weight assembly and action bar.
FIG. 4 is a fragmentary plan view of the inertia weight assembly and action bar shown in FIG. 3.
FIG. 5 is a sectional view taken along the line 5—5 of FIG. 3.
FIG. 6 is a sectional view taken along the line 6—6 of FIG. 3.
FIG. 7 is a sectional view taken along the line 7—7 of FIG. 3.

The shotgun 10 is fired by operating a convention trigger mechanism (not shown) which releases a spring driven hammer to strike a firing pin carried by the bolt assembly. After the gun is discharged the bolt remains locked in battery position, as it appears in FIG. 1, until the shot and wad clear the gas port 24, whereupon gases of explosion bled from the bore 16 enter the gas chamber 22 and act upon the piston 54. At the start of the bolt operating cycle the front and rear inertia elements 34 and 36 are in abutting relation to each other with the action bar connecting portion 46 disposed therebetween and engaging the abutment surfaces 58 and 66, as best shown in FIG. 4. The latter condition being attained by the biasing force of the return spring 39 acting upon the inertia assembly 32. As the piston 54 leaves the gas chamber 20 it provides the initial impetus to impel the inertia weight assembly 32 and action bar 38 rearward relative to the bolt assembly 26 which is still locked in battery position. Initial rearward movement of the action bar-inertia weight assembly relative to the bolt 28 cams the bolt locking element 30 out of the locking recess 40. Thereafter, the bolt, action bar and rear inertia weight continue to travel rearwardly until the bolt impacts upon the receiver. As the action bar is impelled toward the rear of the receiver, the tailpiece 48 engages the hammer (not shown) and pivots it to its cocked position. An elevator pawl, indicated at 68 and in the path of the platform 49 is also pivoted to a depressed position by the moving action bar. The resistance encountered by the action bar 38 in moving the hammer and pawl 68 tend to slow its travel so that the bolt 28 strikes the receiver 12 before the cam element 50 impacts against the rear wall of the bolt.

Some of the energy imparted to the rear inertia element 36 by the moving piston 54 is absorbed in compressing the return spring 39. Some of the energy of the action bar 38 may also be absorbed in compressing the latter spring, so that the rear inertia weight 36 and the action bar 38 may travel for some distance with the forwardly facing abutment surface 66 in engagement with the rear surface of the connecting portion 46.

After impact, the return spring 39 causes slight forward movement of the action bar relative to the bolt to allow the elevator pawl 68 to engage the action bar within a slot 70 in the platform 49 whereby to releasably latch the bolt assembly 26 and action bar 38 in a retired or open bolt position.

The parts of the system are dimensioned to provide travel allowance for the rear inertia weight 34 after the action bar impacts upon the bolt or comes to rest. This travel allowance or clearance is indicated by the letters C, C in FIG. 2. Thus, the rear inertia element continues its rearward travel after the rearward travel of the action bar has been arrested, as it appears in FIG. 2. The rear inertia element impacts upon a plastic buffer 72 mounted on the front end of the receiver.

Some of the energy imparted to the front inertia element 34 by the gases of explosion is spent in impelling the other parts of the mechanism toward the rear. Since the front inertia element is somewhat lighter in weight than the other elements in the system it travels at a somewhat slower rate and tends to lag behind the other elements. The front inertia element impacts against the front end of the action bar 38 after the rear inertia element 36 has struck the buffer 72. Thus, four separate and distinct impacts occur within the system as the bolt assembly moves from battery to a retired position.

The elevating pawl 68 is provided to hold the bolt assembly in a retired position until the spent shell has been ejected and a fresh shell is fed from the magazine tube into a loading position within the receiver. A conventional elevator mechanism associated with the trigger assembly raises the fresh shell to a position of general alignment with the face of the bolt and the chamber and simultaneously retracts the elevator pawl to a position below the platform which releases the action bar to return to its forward position in response to the biasing force of the return spring 39. The fresh round is chambered by the bolt as it returns to battery position. After the bolt 28 attains its battery position the action bar continues to advance under the biasing force of the return spring 39 to cam the bolt locking element 30 to its locking position and return the piston 54 to its forwardmost position within the cylinder 20.

The elevator mechanism or cartridge lifter which operates the elevator pawl 68 has not been illustrated or described, because such mechanism is well known in the art. However, a trigger assembly which includes such mechanism is illustrated and described in U.S. Pat. No. 2,909,101 to Hillberg, hereinbefore discussed, which is hereby adopted by reference as a part of the present disclosure. Reference may be had to the Hillberg patent for further information relating to a trigger assembly which includes such mechanism and which may be used in the gun 10.

The buffer 72, mounted on the front of the receiver has a forwardly opening recess defined at its inner end by a radially disposed annular surface which provides a seating surface for the rear end of the retaining spring 39. It also serves to retain a forearm or fore-end (not shown). The fore-end has a rearwardly opening recess at its rear which receives and substantially complements an associated portion of the buffer. Thus, the buffer performs three functions in that it serves as a buffer, a spring retainer and a retention member for the fore-end.

I claim:

1. In an autoloading firearm having a receiver, a barrel secured to the receiver and having a bore, a breech bolt assembly supported within the receiver for movement between battery and retired positions, and gas actuated operating means for moving the bolt assembly in one direction from its battery position toward a retired position and including inertia means connected to the bolt assembly, the improvement wherein said inertia means comprises a plurality of elements including first and second inertia elements and a connecting element for connecting said inertia elements to said bolt assembly, said first and second inertia elements differing in weight from each other and from said bolt assembly, said elements being movable relative to each other and to said bolt assembly during movement of said bolt assembly from its battery position toward its retired position.

2. In an autoloading firearm as set forth in claim 1 the further improvement wherein said second inertia element weighs more than said first inertia element and is supported between said first inertia element and said receiver.

3. In an autoloading firearm as set forth in claim 2 the further improvement wherein said connecting element weighs more than said first inertia element and less than said second inertia element.

4. In an autoloading firearm as set forth in claim 3 the further improvement wherein said bolt assembly weighs more than any one of said elements comprising said inertia means.

5. In an autoloading firearm as set forth in claim 4 the further improvement wherein said connecting element is connected to said inertia elements intermediate said first inertia element and said second inertia element.

6. In an autoloading firearm as set forth in claim 5 wherein said connecting element comprises an action bar having a pair of parallel side members connected together at one end by a connecting portion which extends therebetween, the further improvement wherein said connecting portion is disposed between said first inertia element and said second inertia element.

7. In an autoloading firearm as set forth in claim 6 wherein the further improvement comprising biasing means acting between said receiver and said second inertia element and biasing said inertia elements in a direction away from said receiver.

8. In an autoloading firearm as set forth in claim 1 and having a magazine tube secured to and projecting from said receiver, the further improvement wherein inertia elements are supported by said magazine tube.

9. In an autoloading firearm as set forth in claim 8 the further improvement comprising means for preventing angular movement of said inertia elements relative to each other about the axis of said magazine tube.

10. In an autoloading firearm as set forth in claim 8 the further improvement comprising a spring coaxially surrounding said magazine tube and acting between said one of said inertia elements and said receiver for biasing said inertia elements in a direction away from said receiver.

11. In an autoloading firearm as set forth in claim 10 the further improvement wherein said gas actuated operating means comprises an annular piston defined by one of said inertia elements and coaxially surrounding said magazine tube.

12. In an autoloading firearm having a receiver, a barrel projecting from the receiver and having a bore, a breech bolt assembly mounted within the receiver for reciprocation between battery and retired positions, inertia means mounted for reciprocation in generally parallel relation to the barrel, means for connecting the breech bolt assembly to the inertia means, means for defining a gas chamber, means for defining a gas port communicating with the bore and the gas chamber to allow gases of explosion to enter the gas chamber when the firearm is discharged, and piston means associated with the gas chamber for moving the inertia means in one direction in response to force exerted by gases of explosion within the gas chamber to urge said breech bolt assembly from its battery position toward its retired position, the improvement wherein said inertia means comprises an inertia assembly including first and second inertia elements, one of said elements being of greater weight than the other of said element, said connecting means having a connecting portion disposed between said first and second inertia elements, said inertia elements being movable in said one direction relative to each other and to said connecting means.

13. In a autoloading firearm as set forth in claim 12 wherein said piston means is defined by one of said inertia elements.

14. In an autoloading firearm as set forth in claim 13 and having a magazine tube projecting from the receiver in axially parallel relation to the barrel the further improvement wherein said inertia elements are supported for axially sliding movement on and relative to said magazine tube and said piston comprises an annular piston coaxially surrounding said magazine tube.

15. In an autoloading firearm as set forth in claim 12 including means for connecting said first and second inertia elements to prevent separation during movement in said one direction and in a direction opposite said one direction.

16. In an autoloading firearm as set forth in claim 15 the further improvement wherein means connecting said first and second inertia elements comprises coengageable abutment surfaces on said inertia elements.

17. In an autoloading firearm having a receiver, a barrel secured to the receiver and having a bore, a breech bolt assembly supported within the receive for movement between battery and retired position and including a bolt and a bolt locking element carried by the bolt and movable relative to the bolt between locking and releasing positions, the bolt locking element being disposed in a locking recess within the receiver when the bolt is in battery position, and gas actuated operating means for moving the bolt assembly from its battery positon toward a retired position and including inertia weight means, an action bar connected to the inertia weight means and to the bolt assembly and movable relative to the bolt assembly to move the bolt locking element to its locking position and to its releasing position, the action bar being movable relative to the bolt assembly and to a blocking position wherein it blocks the locking element in its locking position, means for moving the inertia weight means in one direction in response to force exerted by expanding gases of explosion produced when the firearm is discharged, and biasing means urging said inertia weight means in a direction opposite said one direction, the improvement comprising said inertia weight means including a plurality of inertia elements having differing weights, said biasing means cooperating with said inertia weight means to retain said inertia weight means and said action bar in fixed position relative to said bolt assembly when said action bar is in its blocking position, said inertia elements being free to move relative to said action bar and to each other while said inertia means is moving in said one direction.

18. In an autoloading firearm as set forth in claim 17 the further improvement wherein one of said inertia elements is supported between another of said inertia elements and said receiver, said one inertia element is heavier than said other inertia element, and said biasing means is engaged with said one inertia element.

* * * * *